United States Patent [19]

Taylor

[11] Patent Number: 4,784,755

[45] Date of Patent: Nov. 15, 1988

[54] DUST CONTROL

[75] Inventor: Jimmy D. Taylor, Hereford, Tex.

[73] Assignee: Allied Millwrights, Inc., Hereford, Tex.

[21] Appl. No.: 872,517

[22] Filed: Jun. 10, 1986

[51] Int. Cl.[4] ..... B07B 4/02

[52] U.S. Cl. ..... 209/136; 55/304; 55/439; 55/459.1; 209/137; 209/147; 406/100

[58] Field of Search ..... 209/136, 137, 133, 146, 209/147, 149, 139 R, 138, 144; 406/81, 79, 99–102, 53, 173, 145, 98; 55/459.1, 439, 461, 334, 337, 304

[56] References Cited

U.S. PATENT DOCUMENTS

| | | | |
|---|---|---|---|
| 289,159 | 11/1883 | Spreckels | 406/81 |
| 820,867 | 5/1906 | Henninger | 209/147 |
| 1,048,477 | 12/1912 | Allington | 406/117 |
| 1,176,869 | 3/1916 | Starnes et al. | 209/147 |
| 1,508,682 | 9/1924 | Dowdall | 209/147 |
| 1,562,946 | 11/1925 | Dowdall | 209/147 |
| 1,629,991 | 5/1927 | Budd et al. | 209/147 |
| 1,792,962 | 2/1931 | Barker | 209/147 |
| 2,472,053 | 5/1949 | Dorfan | 209/147 |
| 2,482,159 | 9/1949 | Delivuk | 209/147 |
| 2,617,531 | 11/1952 | Palmer | 209/147 |
| 2,904,176 | 9/1959 | Arndt | 209/147 |
| 3,441,131 | 4/1969 | Gebauer | 209/146 |
| 3,572,503 | 3/1971 | Hezel | 209/138 |
| 3,580,641 | 5/1971 | Schloss | 209/139.1 |
| 4,071,441 | 1/1978 | Schauer | 209/138 |
| 4,410,106 | 10/1983 | Kierbow et al. | 406/53 |
| 4,637,826 | 1/1987 | Stephenson | 55/304 |

FOREIGN PATENT DOCUMENTS

| | | | |
|---|---|---|---|
| 115542 | 7/1942 | Australia | 209/144 |
| 2720888 | 11/1977 | Fed. Rep. of Germany | 55/459 R |

OTHER PUBLICATIONS

"A Graphical Method of Sizing Cyclone Dust Collectors", *Heating and Ventilation*", Leonard Monroe, Dec., 1950, pp. 63–66.

*Industrial Ventilation*, 1984, pp. V, VI, XI, XII, XIII, 4–7, 5–36, 5–37, 5–38, 5–127, 6–36, 10–2, 10–3, 11–27, and 11–28.

Sales brochure "Allied Gravitron Particulate Separation System", 5/29/86.

Design and Operation of Dry Centrifugal Dust Collectors", pp. 243–261, Shumate.

*Primary Examiner*—Robert B. Reeves
*Assistant Examiner*—Donald T. Hajec
*Attorney, Agent, or Firm*—Wendell Coffee

[57] ABSTRACT

Product, such as grain, is cleansed of particulate, such as dust, as it is being conveyed in the normal receiving, storage, and shipping processes. The particulate is sucked from the product by large volumes of low velocity air. The particulate is sucked from the product at a time that the product is near a port in the side of a discharge transition of the conveyor. It is sucked at the discharge transition because at that point, the grain is in motion and agitated, as well as being near the walls of the conveyor. Furthermore, the conveying of product will create a wind or movement of air which airs the sucking of the particlate from the product. The fan causing the suction is placed as near as possible to the conveyor so that the air and particulate, once removed, is moved through the particulate pipes under pressure rather than under suction. Also, all of the particulate pipes carrying the particulate and air are at an angle greater than 55° to horizontal, the angle of repose for dust in the particulate pipes. The particulate is separated from the air in a large diameter bin which is also used to store the particulate until its removal from the particulate bin.

24 Claims, 4 Drawing Sheets

DUST CONTROL

BACKGROUND OF THE INVENTION:

(1) Field of the Invention

This invention relates to a structure and process for controlling and removing particulate in product handling.

(2) Description of the Related Art

As used herein, the term "product" or "granule" refers to grain, coal, rocks, lie soap, fertilizer, or any product that has particulates. Although the product will normally be an agricultural product and a grain such as wheat, sorghum, corn, oats, rye, barley, and the like, it will be understood that it could also be other agricultural products such as peas, beans, vegetable seed, and the like. "Product" or "granule" is also meant to include extremely small product size such as what might be considered to be powder including gravel, sand, soil or powdered lime, or other industrial material. "Particulate" is meant to include all very fine material, and particularly that material that is held in suspension by air moving at a velocity of 2,000 feet per minute and is picked up and re-entrained in the air moving at a velocity of 3,500 feet per minute.

In this regard, when the term "conveyed" or "conveyor" is used, it is intended that it be used in its broadest sense of moving product from one location to another location. Typical of conveyors of product would be bucket lifts, belt conveyors, and also inclined chutes or pipes and discharge transition.

Particulate, in a smooth pipe, will have an angle of repose of about 55°. In commercial practice, before my invention, particulate was moved in horizontal pipes with the air velocity of 3,500 feet per minute to keep the particulate suspended and to re-entrain the particulate. See ALLINGTON, U.S. Pat. No. 1,048,477; ALLINGTON, U.S. Pat. No. 840,894, and BUDD ET AL., U.S. Pat. No. 1,629,991. Thus, when a process was being interrupted and the fans cut off, the particulate in the pipe would fall to the bottom of the pipe. Particulate remains in suspension at 2,000 feet per minute, but experience indicates a velocity of 3,500 feet per minute is needed to pick up and re-entrain particulate when it is on the bottom of a pipe. See *Industrial Ventilation,* 18th edition, 1984 American Conference of Government Industrial Hygienist, Cincinnati, Ohio, pages 4–7. Thus, fans having sufficient power to move the air at 3,500 feet per minute were used.

In the harvesting of agricultural product, the product will often have particulate matter associated with it. E.g., insects, bees wing, red dog chaff, plant particles such as bits of stems, leaves, parts of the grain heads, and the like. Furthermore, in handling and conveying the product, the friction of the product against itself will abrade some of the product; and therefore, each time the product is handled, additional particulate is produced. It is well known that when agricultural particulate is mixed in the air and enclosed, it forms an explosive mixture.

It has long been a desire to control the particulate in bucket elevators and to remove as much particulate as possible and particularly to keep as much particulate from being within the air as possible. Likewise, it has been recognized that it is desirable to clean the product to remove everything from the product except the product itself. This includes all particulates discussed above. According to the prior art before my invention, normally the removal of foreign matter was carried on in different processes than the removal of the dust itself. See HEDLEY, U.S. Pat. No. 3,400,816.

Before this invention, the removal of dust was characterized by removing the dust from a portion of any conveyor closure which was remote from the stream of the conveyed product. E.g., see DELIVUK, U.S. Pat. No. 2,482,159; DOWDALL, U.S. Pat. No. 1,508,682; DOWDALL, U.S. Pat. No. 1,562,946; PALMER, U.S. Pat. No. 2,617,531; LORENZEN, U.S. Pat. No. 2,415,503; PATTERSON, U.S. Pat. No. 2,513,963; and *Industrial Ventilation,* pages 5-36, 5-37, and 5-38.

Axial flow fans within an air conduit are known. ZACK, U.S. Pat. No. 4,515,071; *Industrial Ventilation,* pages 10-2 and 10-3.

*Industrial Ventilation,* pages 11-27 and 11-28 shows typical equipment for separating dust from air.

Also, the practice before this invention was to place the fan at a distance remote from where the air was removed from the conveyor. It was not unlikely that the fan would be at or beyond the point where the dust was separated from the air. It was characteristic to use on collecting fan for several intakes of particulate. See *Industrial Ventilation,* 4-7. Therefore, it was necessary to increase the diameter of pipe, but yet it was necessary that the pipe not be increased to such a point till the velocity was less than 3,500 feet per minute. *Industrial Ventilation* pages 6-36 shows a typical increase in diameter.

Before this application was filed, the applicant caused a search to be made in the U.S. Patent and Trademark Office. In addition to the patents discussed above, the following patents were found on that search:

SCHNEIBLE ET AL: 2,579,401
FRASIER ET AL: 3,016,813
ARALT: 3,870,168
CARPENTAR: 4,241,517

Applicant does not consider these patents as pertinent as those specifically discussed above, but believes the Examiner would consider anything revealed by an experienced patent searcher to be relevant and pertinent to the examination of this application.

SUMMARY OF THE INVENTION:

(1) Contribution to the Progress of Useful Arts

I have invented equipment to improve removal of particulate from equipment conveying product.

According to this invention, the particulate is removed from the conveying equipment at a discharge transition or spout of the conveyor. The product matter is concentrated at the discharge transition; and therefore, sucking up the particulate at this point is the most efficient place. Also, at the discharge transition, normally the product will be agitated or in motion, not only with respect to the conveyor, but also in connection with itself. Therefore, at the discharge transition, not only is the stream of product concentrated and nearer to any suction that might be introduced, but also the product is in a moving, or turmoil, or agitated condition where the particulate is readily released from the stream. As used herein, when the product is in a moving, turmoil, or agitated condition at a discharge transition, it is referred to as being in "suspended flow". I.e., normally the product will be moving without being supported by supporting structures; it will have been discharged from one bucket or belt or chute and is moving unsupported or in "suspended flow" to its next supported position. It will be understood that normally, when the product matter is being conveyed, it will be quiescent.

One of the principle advantages of the invention is that the product can be cleaned and the particulate removed in normal processing of the product. The product is often moved many times in an elevator. It is first moved from the receiving pits to a storage bin. It is finally moved from a storage bin to a transport vehicle. However, between these two moves, it is often moved for the purpose of blending different qualities of product and also for moisture and temperature control. If particulate is removed from the product each time the product is moved, the system in effect, cleans the product during processes which will be conducted in any event. Thus, there is the advantage that it is not necessary to have a cleaning operation which is separate and different from operations which are required primarily for other purposes.

To accomplish this, a large volume of controlled low velocity air is employed. For this reason, no hood is used at the particulate port where the intake particulate tube section connects to discharge transition. The hood inherently reduces the velocity of the air at the pickup point. So that none of the product is picked up, it is sometimes necessary to reduce the velocity of air at the particulate port. To reduce the velocity, dilution air is introduced on the upstream side of the fan through the excess air gate. I.e., if a portion of the air feed to the fan comes from another source (excess air gate), the velocity as well as the volume of the air from the conveyor will be reduced. It is best to let the operator adjust this so that he picks up as much of the particulate as he desires. E.g., if the product being conveyed is oats, the kernels of which are very light, it will be necessary to reduce the velocity of air, or an excessive amount of oat kernels will be picked up and carried to the dust bin. On the other hand, if the product is wheat, which is heavier than oats, and also if the operator desires to clean the wheat as much as possible, he would find it desirable to use the maximum velocity the system produces.

The conveyor moving at high speed will generate wind. Therefore, if the particulate is sucked out at the discharge transition, the wind generated by the conveyor itself will work with the fan to move the particulate and air. I.e., if the particulate port is at the end of the conveyor, the existing air in the conveyor is moving in that direction. If it were placed at the beginning of the conveyor, it has to pull the air in the opposite direction from the movement of the conveyor. Therefore, more power must be utilized to pull the air plus particulate.

Further, this invention uses an axial flow aluminum fan located close to the particulate port where the air and particulate is removed from the conveyor. It has been found desirable to have the aluminum fan spaced at a length of at least four and no more than twenty pipe diameters from the discharge transition. About eight time pipe diameter is the desired distance.

An axial flow fan in the fan section of the particulate tube is preferred without any straightening vanes. I.e., I desire to permit, and in fact, encourage a helical or cycloning flow within the particulate tube at the particulate port where the air first emerges from the discharge transition. As stated before, the axial velocity through the particulate tube is maintained as low as possible in order to extract particulate without product removal. The consequent enlargement of particulate tube size further reduces the velocity which increases the effectiveness of particulate separation from air through the constant lowering of velocity. As a result of the 60° angle of the particulate tube, extraction of particulate from product is obtained without screening. The 60° angle provides gravity self cleaning when the system is shut down. The cycloning motion will act somewhat as a centrifugal separator to help separate out the heavier particles from the material sucked from the discharge transition. Another result of the cycloning or helical flow is more of a scouring of the pipe walls to prevent any particulate which might stick there, even though the pipe angles upward at an angle of 60° or more.

Also, the particulate is picked up and moved in a direction which angles from horizontal at an angle of greater than 55°. Increased angle increases particulate discharge at particulate port upon shut down. Having the particulate removed at this angle achieves two results; one, when the fan is turned off, the particulate will slide out of the pipe and never build up within the pipe. Therefore, a velocity of 2,000 feet per minute may be used because it is never necessary to pick particulate up and re-entrain the particulate into the air stream. Second, having the air moved upward helps to separate and classify the material removed from the flowing stream of the product. I.e., even though initially some kernels of product may have been diverted from the conveyor into the particulate stream, these kernals will drop out of the particulate tube section back into the conveyor product stream because of gravity separation. However, all of the particulate will be carried up and away from the conveyor product. The degree of separation is primarily controlled by the bleed air which is admitted into the fan through the excess air gate as discussed above.

From the fan section, the pipe carrying particulate is curved in a long radius elbow to angle downward at 60° or greater. After the air is angled downward, for convenience sake, two or three discharge particulate spouts may be gathered together into a larger spout. Once the particulate flow is angling downward, the diameter of the discharge particulate spout is maintained, thus never increasing the air velocity. Because the pipe is angling downward at an angle greater than the 55° angle of repose, it is not necessary to have a high velocity of air to move and entrain the particulate. The particulate moves by gravity. By maintaining a low velocity in the particulate pipe, frictional loss is less; and therefore, the horsepower for the fan is greatly reduced.

Particulate is conveyed from the long radius elbow to a discharge particulate spout which conveys particulate into the particulate separation of dust bin. I prefer to combine the function of particulate air separation and particulate storage into a single bin.

In brief, I prefer:

(1) to move the air in the particulate tube and spout in a cycloning path.
(2) to connect the particulate tube into the discharge transition on the product conveyor.
(3) to place the aluminum fan at about eight diameters from the particulate port.
(4) to move the particulate at low velocity (2,000 fpm) to conserve energy and help separation of particulate from product.
(5) to remove the air and particulate from the product conveyor at the particulate port in as close proximity as possible to the stream of the product.

(6) that the particulate tubes carrying the air from the product conveyor be angled downward at an angle of 60° or greater as soon as possible.
(7) to increase the discharge particulate spout in diameter to maintain low velocities, and
(8) to store the particulate in the same bin wherein it is separated from air.

(2) Objects of this Invention

An object of this invention is to remove particulate from a product while it is conveyed from one point to another.

Further objects are to achieve the above with devices that are sturdy, compact, durable, lightweight, simple, safe, efficient, versatile, ecologically compatible, energy conserving, and reliable, yet inexpensive and easy to manufacture, install, adjust, operate and maintain.

Other objects are to achieve the above with a method that is rapid, versatile, ecologically compatible, energy conserving, efficient, and inexpensive, and does not require highly skilled people to install, adjust, operate, and maintain.

The specific nature of the invention, as well as other objects, uses, and advantages thereof, will clearly appear from the following description and from the accompanying drawings, the different view of which are not scale drawings.

Figure 1:
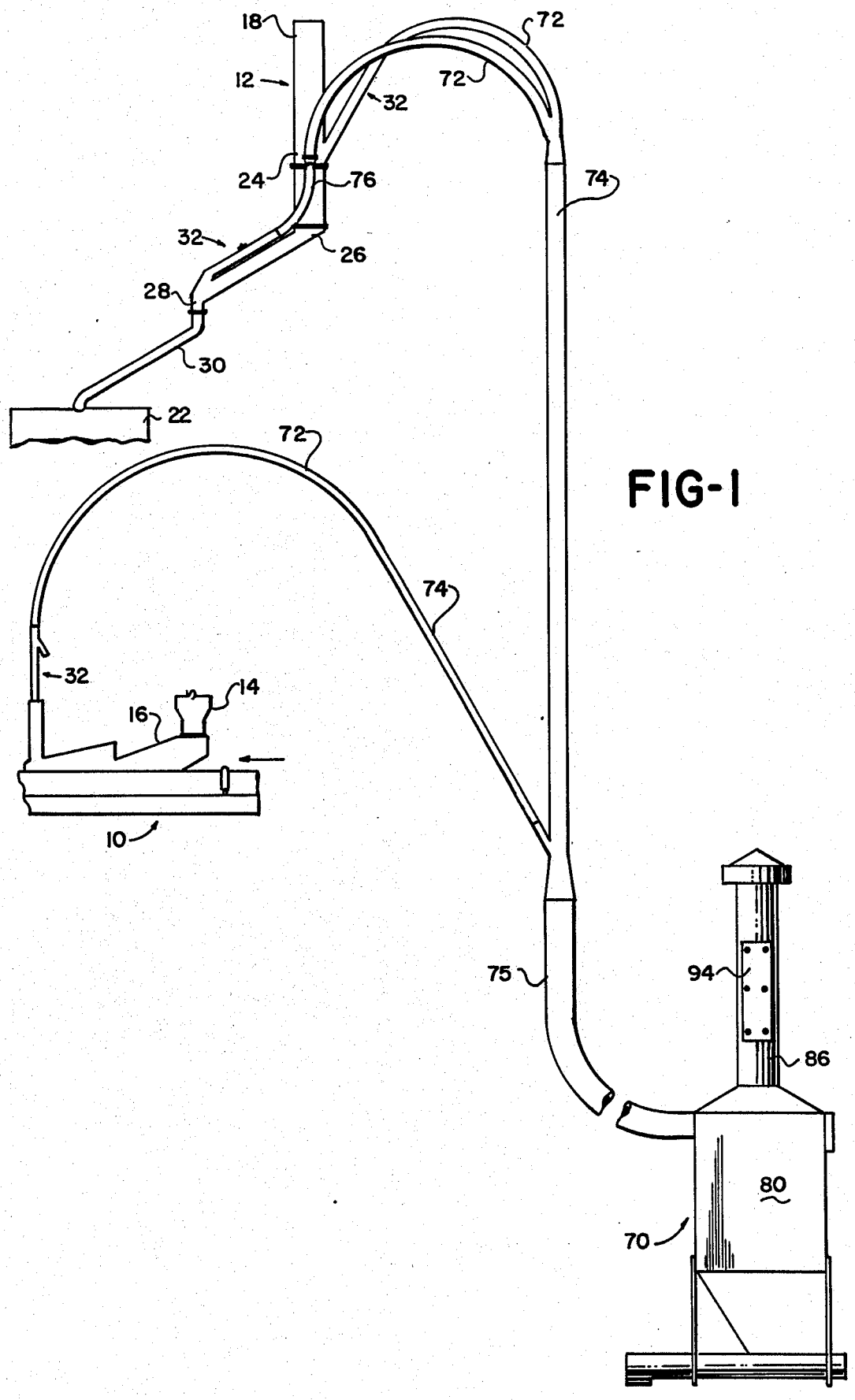
FIG. 1 is a schematic representation of an embodiment of this invention.

As in aid to correlating the terms of the claims to the exemplary drawings, the following catalog of elements and steps is provided:

10 belt conveyor
12 bucket elevator
14 pipe or chute
16 tracking shoe
18 elevator head
20 buckets
22 bins
24 discharge transition or horse head
26 turn head
28 down spout
30 pipes
32 particulate pipe
34 intake section
36 side
38 fan
40 fan section
42 rectangular flange
44 rectangular flange
46 pin
48 hinge
49 walkway
50 motor
52 platform
54 conduit
56 junction box
58 disconnect box
60 inspection plate
62 particulate port
64 bleed vent (excess air gate)
66 pivoted gate
68 bolt
70 particulate separation bin
72 long radius elbow
74 discharge spout
75 tail pipe
76 flexible tube sock
78 entry transition
80 cylindrical section
82 roof
83 apex
84 taper
86 stack
88 rain cap
90 exhaust diffuser
92 particulate bag
94 door
96 auger
98 shaker

DESCRIPTION OF THE PREFERRED EMBODIMENT

As discussed above, this invention relates to removing particulate from product matter. A typical example of such is removing particulate from grain in an elevator. FIG. 1 illustrates schematically the movement of product in an elevator. Typically, at a receiving and shipping facility, product will be poured in a dump pit with gravity discharge to bucket elevator 12. The bucket elevator 12 lifts the product to elevator head 18 where the grain is gravity spouted through swivel chute 26 or stationary spouting to tracking shoe 16 where it is discharged onto belt conveyor 10. The belt conveyor conveys the product to its proper storage bin.

The chute 14 from the elevator head 18 will terminate in the tracking shoe 16. The tracking shoe causes the grain or product to move along the same direction as conveyor belt 10. Chute 14 is a conveyor. Tracking shoe 16 is a discharge transition upon the product conveyor or chute 14.

Figure 2:
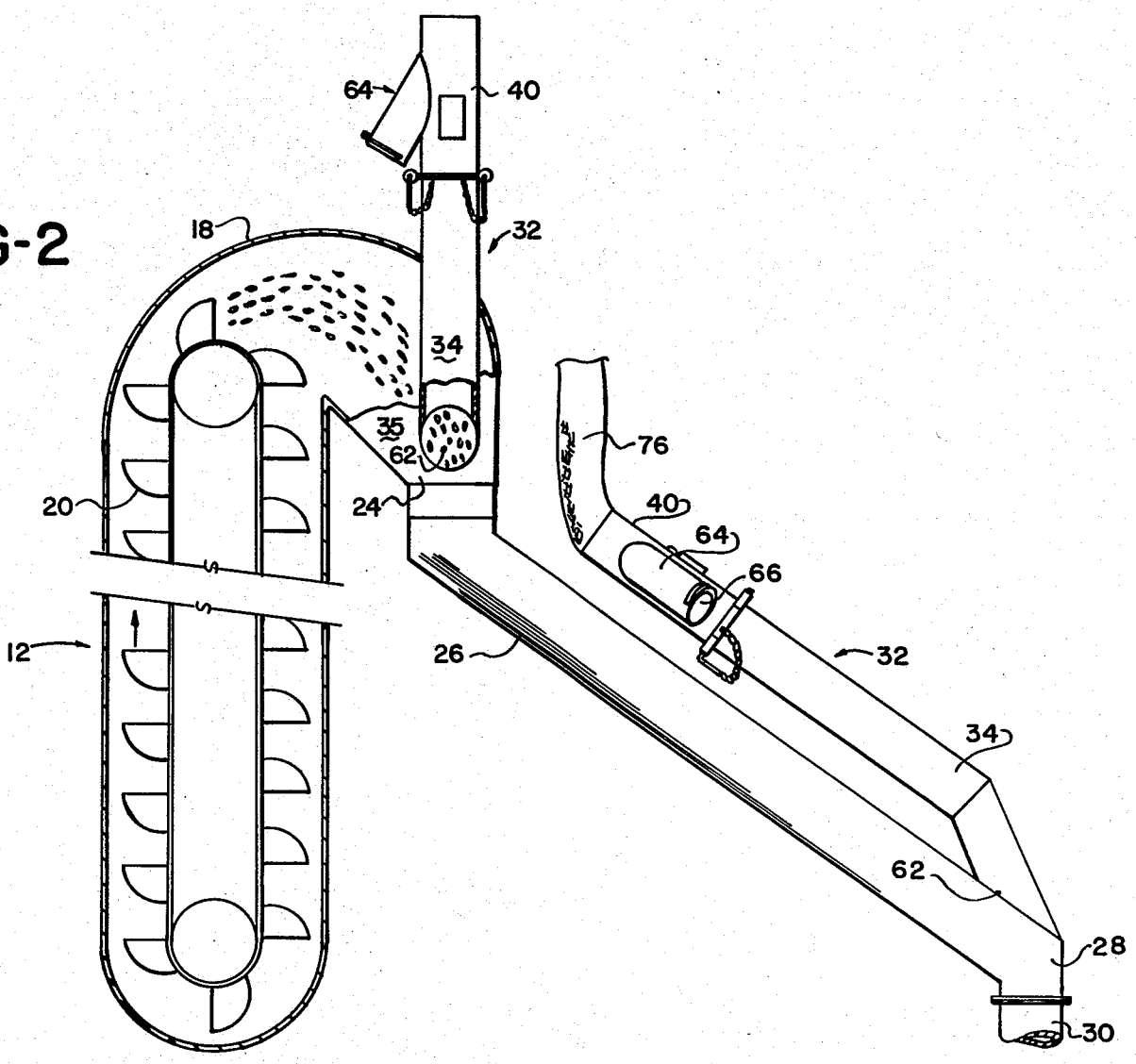
FIG. 2 is a representation of particulate pipes connected to the horse head and the turn head according to this invention.

The bucket elevator 12 (FIGS. 2 and 3) is also a conveyor which lifts the product to the elevator head 18 which has discharge transition 24 known as a horse head. The product is discharged from individual buckets 20 into the discharge transition 24 (FIG. 2). The structure of the discharge transition 24 is also known as a transitional housing.

Often, in an elevator, the product will move from the discharge transition 24 into gravity distributing chute (turn head) 26. The turn head 26 is a product conveyor which is mounted for rotation about a vertical axis which is coaxial with discharge transition 24. The lower, terminal of the turn head will be at down spout 28 which is a discharge chute. From down spout 28, the product will be feed into pipes 30 which are set into the floor of the head house structure. Some of the pipes 30 will lead into bins 22 for storage and some of the pipes 30 will lead into transport means such as railroad cars.

As the discharge chutes or transitions have been described above, i.e., the tracking shoe, the horse head, or the down spout, it will be noted that they are all enclosed spouts or closed conveyors and that they will all have a cross section normal to the flow of product. Analysis will show that if the pipe 30 leads to bin 22, that as the product is fed into the bin that it will discharge air from the bin. Therefore, there will be a flow of air upward from the bin which flow will be through the down spout 28 (the down spout forms a close fit to the pipe 30.) Therefore, if the particulate is sucked off at this point, there will be a flow of air from the bin which aids the sucking of the air, and again, it is not necessary for a fan to move the air in the opposite direction from what is otherwise the normal flow of air.

Those with ordinary skill in the art will recognize that the structure described to this point is old, well known, and thousands of examples of such are in operation in the United States.

Figure 3:
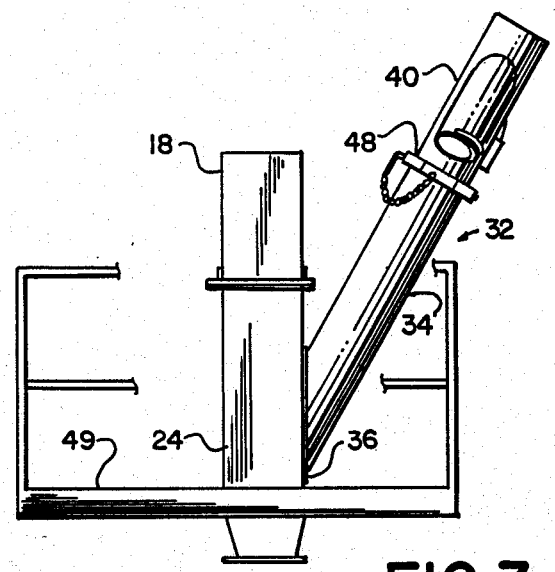
FIG. 3 is an elevational view of a particulate pipe connected to the horse head with a walkway partially shown.

According to this invention, a power vent or particulate pipe 32 is attached to the discharge transition for removing particulate from the product. The particulate pipe has two principle part or sections, intake section 34 and fan section 40 (FIGS. 2, 3, 6, and 7). Intake section 34 is attached as by welding to the discharge transition. Intake section 34 is connected to side 36 of the elevator head 18 at discharge transition 24 (FIGS. 2 and 3). I.e., it is attached to a vertical surface. It is desirable that the intake section angle at a 60° angle to horizontal and to product flow. Thus, analysis shows that heavier material which might be sucked into the intake section by the suction will tend to fall by gravity back into the discharge transition while lighter particulate will be sucked up by aluminum (spark proof) fan 38.

Figure 7:
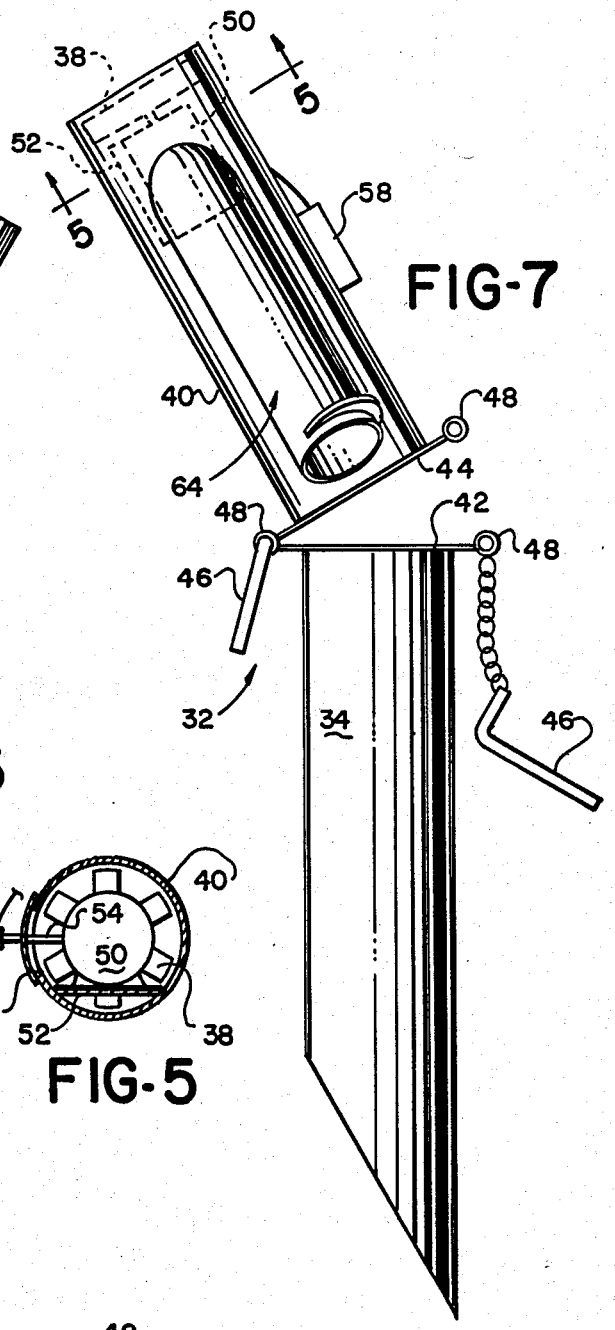
FIG. 7 is an elevational view of the particulate pipe with one pin removed and the fan section partially rotated about the other pin.
Figure 5:
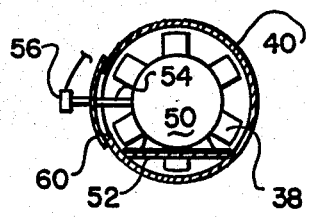
FIG. 5 is a sectional view taken substantially on line 5—5 of FIG. 7 of the axial motor within the fan section.
Figure 4:
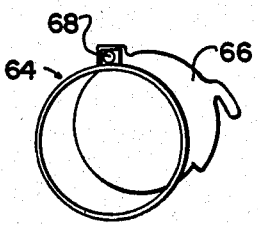
FIG. 4 is an end view of the excess air gate.
Figure 6:
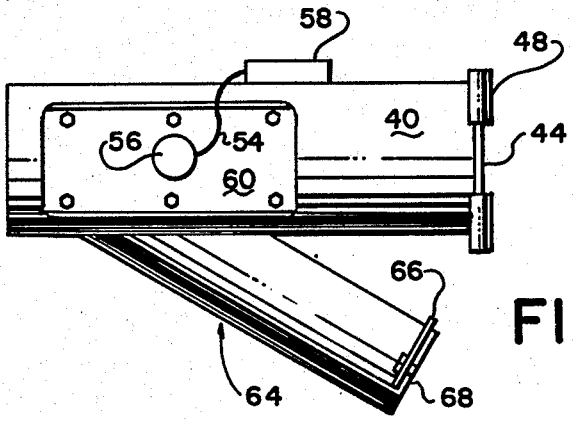
FIG. 6 is a side elevational view of the fan section of the particulate pipe.
Figure 8:
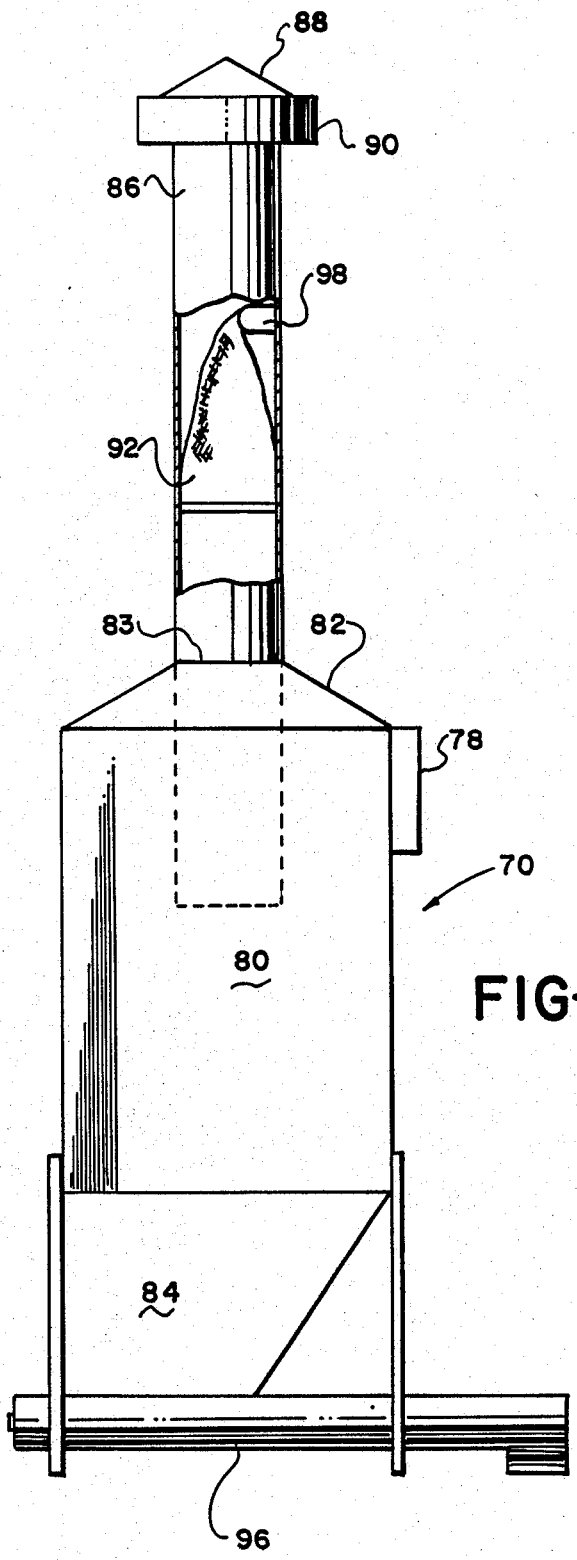
FIG. 8 is a elevational view of the particulate separation bin.

The fan 38 is in the fan section 40. Rectangular flange 42 is attached to the discharge end of the intake section 34. Mating rectangular flange 44 is attached to the intake end of the fan section 40. These two flanges, 42 and 44, are connected together by pin 46 located through hinges 48 on each side of each of the rectangular flanges. Therefore, it may be seen that for service that a workman can readily pull one pin 46 and rotate the fan section 40 about the other pin 46 onto walkway 49 (FIGS. 3 and 7). It will be understood that the two hinges 48 are identical so that the fan section may be rotated either to the right or left, whichever is more convenient for the workman. Also, it will be understood that both pins 46 could be pulled and the fan section removed completely.

The axial vane fan 38 with electric one horse power explosion proof motor 50 are located within the fan section 40. The motor 50 is mounted upon platform 52 inside the fan section. The motor 50 is upstream from the fan 38. The electrical wiring for the motor extends outward to run through conduit 54 to junction box 56 mounted outside the section 40. From there, the wiring extends to a stop-start disconnect box 58. From there, the wiring extends to a source of electrical power.

Inspection plate 60 is attached to the fan section 40. For minor maintenance or routine inspection, the inspection plate 60 may be removed. The fan 38 is directly connected to the output shaft of motor 50. The fan 38 is coaxial with fan section 40 which is also coaxial with the intake section 34. Both the fan section and intake section are circular cross section pipes. The intake section 34 is fluidly connected to the discharge transition by intake port 62. The intake port will be the size of the intersection of the particulate pipe 32 and the discharge transition. I.e., the cross sectional area of the air from the discharge transition to the motor 50 is constant. It neither increases nor decreases. As explained above, it is necessary for the velocity of the air within the particulate pipe 32 to be about 2,000 feet per minute for the particulate to remain in suspension.

It the intake port is to remove any particulate from the stream of product that pass through the discharge transition, it is necessary the intake port 62 be in proximity to the stream or flow of the product. It has been determined that it is necessary for the cross sectional area of particulate pipe 32 to be at least $\frac{1}{4}$ of the cross sectional area of the discharge transition. When the term "cross sectional area of the discharge transition" is used herein, it is meant the cross sectional area normal to the flow or stream of product through the discharge transition.

For manufacturing procedures, it is desirable that standard fan sections be made with standard one horse power explosion proof motors (3,600 rpm) and aluminum (spark proof) axial fans. In some instances, they will produce suction at the intake port which picks up the product. This is particularly true if the product being handled is oats, the oat kernel being particularly light. Therefore, it is desired to be able to reduce the suction at the intake port 62. This could be done by using a slower motor or a fan with shorter blades. To make the adjustment to meet the desires of any operator and so that it may be readily adjustable in the field, I prefer to place bleed vent or excess air gate 64 into the fan section 40. The bleed vent 64 is a pipe which connects into the particulate pipe 32 upstream of the fan 38. It is desirable that it connect into the fan section 40 at a 30° angle to minimize turbulence. Bleed vent 64 has pivoted gate 66 therein. The pivot of the gate is parallel to the axis of bleed vent 64 near the periphery thereof. The pivot is in the form of a simple threaded bolt 68 so that when gate 66 is opened a desired amount to permit sufficient bleed air to enter, it may be clamped to position by tightening the bolt 68. It will be understood that the fan blows a certain amount of air. All the air coming through the bleed vent will be diverted from the air entering from the intake port, thereby reducing the suction at the intake port. Reducing the suction will limit the material picked up to particulate and avoid picking up whole kernels of product.

The preferred embodiment of this invention does not include any straightening vane within either the intake section 34 or the fan section 40. Therefore, the fan not only forms a means for moving air through the particulate pipe 32 at about 2,000 feet per minute, but also forms means for causing a helical or cycloning flow of air through the pipes. Helical or cycloning flow is desired in this usage to prevent the particulate from sticking to the walls of the dust particulate pipe 32. Also, the helical flow will aid in separating heavier product from the lighter particulate.

It is preferred to move the air under positive pressure whenever possible and to avoid moving the air by suction. Therefore, the fan is placed as close as possible to the intake port 62, yet leaving sufficient room for whatever separation and the like might occur before the fan. Through experience, it has been determined that it is desirable to have the fan more than four pipe diameters from the intake port 62 and less than 20 pipe diameters from the intake port 62. The pipe diameter in this case means the diameter of the particulate tube 34. It will be noted that the two sections of the particulate pipe 34 are the same diameter. The preferred distance of the fan from the port is eight diameters.

From the fan section 40, the particulate entrained in the air stream is moved to particulate separation or dust bin 70.

It is desirable that the particulate separation bin 70 be located at a lower elevation than the elevator head 18. Therefore, the pipe leading from the fan section to the particulate separation bin 70 is angled downward as soon as possible. To decrease friction to a minimum and thereby conserve power, as long a radius of piping as possible is used. Therefore, large radius elbow 72 is connected to the end of the fan section. Of course, the physical limitations within each head house of each elevator will require different connections. As soon as the long radius elbow 72 is complete then discharge spout 74 extends onto the tail pipe 75. It will be understood that normally the exhaust from a plurality of fan sections would be gathered into a single tail pipe 75. These transitions would often deviate from a standard transition by being tangential transition to induce helical flow into the tail pipe. The tail pipe diameter would increase so that the tail pipe cross sectional area would be at least the sum of the cross sectional areas of all the discharge spouts 74 which joined into it. I.e., that the velocity in the tail pipe 75 would be no greater than the velocity of the air in the discharge spout 74 and no greater than the particulate pipe 32.

Those with skill in the art will recognize that the fan section 40 pipe connected to the long radius elbow 72 upon turn head 26 must move relative to the other piping. Those with ordinary skill in the art will understand that a rotational or movably joints such as a section of flexible sock 76 could be used to provide this flexibility. The flexible sock 76 would connect to long radius elbow 72.

Figure 9:
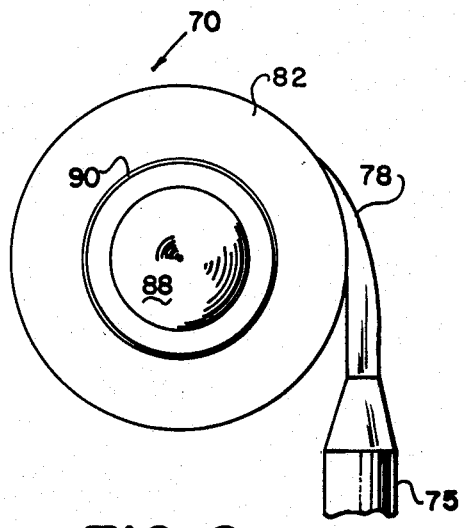
FIG. 9 is a top plan view of the particulate separation bin.

The particulate separation bin 70 has tangential entry transition 78 (FIG. 9). The entry transition 78 would have an elongated rectangular opening into the bin. The entry transition 78 would have at least the cross sectional area of the tail pipe 75 leading into it and perhaps even more; e.g., 20% greater area than the tail pipe.

The particulate separation bin would have a circular cross sectional area which was equal to about 30 times the cross sectional area of the tail pipe 75.

The particulate separation bin 70 would include three sections; a cylindrical section 80, a roof section 82, and a tapered section 84. The cylindrical section 80 would preferably have a cross sectional area no greater than 36 times the cross sectional area of the tail pipe. Roof section 82 would have an apex 83 coaxial with the cylindrical section 80. Air exhaust stack 86 would extend through the apex of the roof. The stack would have a cross sectional area at least four times the cross sectional area of the tail pipe 75. Analysis will show that the velocity in the stack will be less than 500 feet per minute. The tail pipe and the stack would both have a circular cross section. The stack 86 would extend below the apex 83 of the roof 82 at least two times the stack diameter. The stack height above the roof apex 83 is at least five times the stack diameter. The top of the stack would have a standard rain cap 88 and exhaust diffuser 90.

The stack from a particulate bin as described above will discharge air which is sufficient in most areas to meet environmental requirements. However, a slight amount of particulate will still be present in the air. If it is desired to further reduce the particulate discharged from the stack, a particulate bag 92 may be placed inside the stack. In such cases, an inspection door 94 is placed in the stack so that repairmen may have access to the particulate bag. It is desired that a shaker mechanism 98 be attached to the top of this particulate bag 92 to shake the bag so that the thicker particles may be shaken loose from the bag to fall within the particulate bin 70.

The tapered bottom section 84 of the particulate bin 70 will be tapered at an angle of 60° to horizontal so that particulate will slide to the bottom to be collected by auger conveyor 96 to be disposed of. The particulate is collected within the particulate bin and stored within the particulate bin 70 until it is removed by operation of the auger conveyor 96.

The particulate from the particulate bin may be disposed of by conventional means. One commercial use for particulate from grain is to be pelleted and used as animal feed.

In some areas it is considered ecologically permissible that the fan section outlet of the particulate pipe 32 be vented to the atmosphere. Therefore, although it is preferred that the discharge from the fan section be piped to a particulate bin 70 to separate the particulate from the air, this is not a commercial requirement in all cases.

The embodiment shown and described above is only exemplary. I do not claim to have invented all the parts, elements or steps described. Various modifications can be made in the construction, material, arrangement, and operation, and still be within the scope of my invention.

The restrictive description and drawings of the specific examples above do not point out what an infringement of this patent would be, but are to enable one skilled in the art to make and use the invention. The limits of the invention and the bounds of the patent protection are measured by and defined in the following claims.

I claim as my invention:

1. The method of cleaning particulate from grain as the grain is being conveyed in closed conveyors having existing air therein and suspended flow at a location, comprising the steps of:

a. sucking existing air and particulate by a fan from the conveyor upward at an angle to horizontal of greater than 55° and at a velocity of about 2,000 feet per minute from the grain as the grain is being discharged in suspended flow;

b. immediately passing the air through said fan, c. thereby discharging the air and particulate from the fan in a helical motion.

2. The invention as defined in claim 1 further comprising: always maintaining the velocity of the air and particulate at less than 2,000 feet per minute after the particulate has been sucked from the product.

3. The invention as defined in claim 2 further comprising: blowing the air and particulate into a large circular bin, settling the particulate in the bottom of the bin, and blowing the air out of the bin through a stack at a velocity of less than 500 feet per minute.

4. Structure including a. an enclosed conveyor for moving product, a[1]. a grain product in the conveyor, b. an enclosed discharge transitional housing on said conveyor through which the product from the conveyor passes when being discharged from the conveyor, c. said discharge transitional housing having a cross section normal to the flow of product;

wherein the improved structure comprises:

d. a cylindrical particulate tube having
   i. an axis,
   ii. a diameter,
   iii. a circular cross section,
   iv. an intake section, and
   v. a fan section, e. said axis extending upward at an angle to horizontal of greater than 55°, f. said intake section fluidly connected to said discharge transitional housing at g. a particulate port in the transitional housing, h. said particulate port being substantially the size of the intersection of the intake section and the discharge transitional housing, and j. an axial flow fan in the fan section, k. said fan forming a portion of means for moving air through the particulate tube at a velocity of about 2,000 feet per minute, l. said fan being a lesser distance from the particulate port than twenty times the intake section diameter, and m. said fan being a greater distance from the particulate port than four times the intake section diameter.

5. The invention as defined in claim 4 further comprising:

n. the cross sectional area of the particulate port is equal to at least ¼ the cross sectional area of the discharge transitional housing.

6. The invention as defined in claim 4 further comprising:

n. an adjustable vent in the particulate tube between said fan and said particulate port so that the suction at the particulate port is adjustable.

7. The invention as defined in claim 6 further comprising:

o. said fan also forming a portion of means for moving the air and particulate through the cylindrical particulate tube in a helcial motion.

8. The invention as defined in claim 6 further comprising:

o. an inspection door on the fan section.

9. The invention as defined in claim 6 further comprising:

o. an electrical motor within the fan section directly connected to said fan, p. an electrical stop-start disconnect box upon the exterior of the fan section whereby electrical power is connectable to the electrical motor inside the fan section.

10. The invention as defined in claim 6 further comprising:

o. said vent connected to the fan section.

11. The invention as defined in claim 6 further comprising:

o. said fan being a distance from the particulate port equal to about eight times the intake section diameter.

12. The invention as defined in claim 6 wherein o. said conveyor for moving product matter is a bucket elevator in a product elevator having an elevator head section with a discharge point, and p. said discharge transitional housing is the discharge point.

13. The invention as defined in claim 6 further comprising:

o. said conveyor is a turn head distributing gravity chute from a bucket elevator to a product storage bin, and p. said particulate port is in the end of a distributing chute immediately above a stationary down spout leading to the product storage bin.

14. The invention as defined in claim 6 further comprising:

o. said discharge transitional housing is a tracking shoe immediately above a belt conveyor.

15. The invention as defined in claim 6 further comprising:

o. the outlet of the fan section is connected to a long radius elbow which is connected to discharge spout which connects to a tail pipe which runs into a separation bin, p. the separation bin having the function of separating the air from the particulate and storing the separated particulate for removal.

16. The invention as defined in claim 6 further comprising:

o. the cross sectional area of the particulate port is equal to at least ¼ the cross sectional area of the discharge transitional housing.

17. The invention as defined in claim 6 further comprising:

o. said fan section connected to the intake section by a rectangular flange on the intake section and a mating rectangular flange on the fan section, p. said sections having mating hinges on each side thereof, q. a pin inserted into the mating hinges on each side thereof.

18. The invention as defined in claim 6 further comprising:

o. the outlet from the fan section is connected to a long radius elbow to which is connected a discharge spout having a larger diameter than the particulate tube, p. said discharge spout is connected to a tail pipe which has a larger diameter than the discharge spout, q. said discharge spout extending downward at an angle greater than 55° to the horizon, r. said tail pipe attached to a separate bin.

19. The invention as defined in claim 6 further comprising:

o. the outlet from the fan section is connected to a long radius elbow to which is connected a discharge spout having a larger diameter than the particulate tube, p. said discharge spout extending downward at an angle greater than 55° to the horizon, q. said discharge spout is connected to a tail pipe which has a larger diameter than the discharge spout, r. an upright cylindrical section, s. a tangential inlet transition from the tail pipe at the top of the cylindrical section, t. a tapered section at the bottom of the cylindrical section, u. an auger conveyor at the bottom of the tapered section, v. a roof on the top of the cylindrical section, w. an exhaust stack through the roof concentric to the cylindrical section, x. the cylindrical section having a cross sectional area equal to no more than about 36 times the cross sectional area of the tail pipe, y. the stack having a cross sectional area equal to at least about four times the inlet tail pipe cross sectional area, z. the stack extending below the roof a distance equal to at least two times the stack diameter, and aa. the stack extending above the roof a distance of at least about five times the stack diameter.

20. A particulate separation bin comprising:

a. an upright cylindrical section, b. a tail pipe, bb. means connected to the tail pipe for moving air through the tail pipe at a velocity less than 2,000 feet per minute, c. a tangential inlet transition from the tail pipe at the top of the cylindrical section, d. a tapered section at the bottom of the cylindrical section, e. an auger conveyor at the bottom of the tapered section, f. a roof on the top of the cylindrical section, g. an exhaust stack through the roof concentric to the cylindrical section, h. the cylindrical section having a cross sectional area equal to about 30 times the cross sectional area of the tail pipe, i. the stack having a cross sectional area equal to at least about four times the inlet tail pipe cross sectional area, so as to cause the air moving in the stack to be at a velocity of less than 500 feet per minute, j. the stack extending below the roof a distance equal to at least two times the stack diameter, and k. the stack extending above the roof a distance of at least about five times the stack diameter.

21. The invention as defined in claim 20 further comprising:

l. said cylindrical section having a height greater than its diameter, m. a particulate bag in the stack, and n. a shaker mechanism attached to the top of the particulate bag.

22. Structure including a. a conveyor for moving product, b. an enclosed discharge transition on said conveyor through which the product from the conveyor passes when being discharged from the conveyor, c. said discharge transition having a cross sectional normal to the flow of product;

wherein the improved structure comprises:

d. a cylindrical particulate tube having i. an axis, ii. a diameter, iii. a circular cross section, iv. an intake section, and v. a fan section, e. said axis extending upward at an angle to horizontal of greater than 55°, f. said intake section fluidly connected to said discharge transition at g. a particulate port in the transition, h. said particulate port being substantially the size of the intersection of the intake section and the discharge transition, j. an axial flow fan in the fan section, k. said fan forming a portion of means for moving air through the particulate tube a velocity of about 2,000 feet per minute, l. said fan section connected to the intake section by a rectangular flange on the intake section and a mating rectangular flange on the fan section, m. said sections having mating hinges on each side thereof, and n. a pin inserted into the mating hinges on each side thereof.

23. The invention as defined in claim 22 further comprising:

o. said fan being a lesser distance from the particulate port than twenty times the intake section diameter, and p. said fan being a greater distance from the particulate port than four times the intake section diameter.

24. The invention as defined in claim 22 further comprising:

o. said transitional housing is a tracking shoe immediately above a belt conveyor

* * * * *